US009157636B2

(12) United States Patent
Happe

(10) Patent No.: US 9,157,636 B2
(45) Date of Patent: Oct. 13, 2015

(54) GAS REGULATING FITTING

(75) Inventor: Barbara Happe, Gernrode (DE)

(73) Assignee: MERTIK MAXITROL GMBH & CO. KG, Thale (DE)

( * ) Notice: Subject to any disclaimer, the term of this patent is extended or adjusted under 35 U.S.C. 154(b) by 0 days.

(21) Appl. No.: 13/696,006

(22) PCT Filed: May 3, 2011

(86) PCT No.: PCT/EP2011/002181

§ 371 (c)(1),
(2), (4) Date: Nov. 2, 2012

(87) PCT Pub. No.: WO2011/137996

PCT Pub. Date: Nov. 10, 2011

(65) Prior Publication Data

US 2013/0048109 A1 Feb. 28, 2013

(30) Foreign Application Priority Data

May 5, 2010 (DE) ..... 10 2010 019 960

(51) Int. Cl.
*F16K 31/36* (2006.01)
*F23N 5/26* (2006.01)

(52) U.S. Cl.
CPC ..... *F23N 5/26* (2013.01); *F23N 2035/18* (2013.01); *F23N 2035/22* (2013.01); *F23N 2035/24* (2013.01); *Y10T 137/7793* (2015.04)

(58) Field of Classification Search
CPC . F23N 5/107; F23N 2035/14; F23N 2035/24; F23D 2207/00
USPC ..... 137/65, 66, 468; 432/46, 80; 431/67, 431/73, 75, 258
See application file for complete search history.

(56) References Cited

U.S. PATENT DOCUMENTS 2,637,385 A * 5/1953 Mayer ..... 431/46
2,691,705 A * 10/1954 Ray ..... 200/61.86

(Continued)

FOREIGN PATENT DOCUMENTS

DE 10305929 B3 9/2004
DE 10309469 B3 10/2004

(Continued)

OTHER PUBLICATIONS

English language abstract for DE 10305929 extracted from the espacenet.com database on Jul. 18, 2013, 11 pages.

(Continued)

*Primary Examiner* — John K Fristoe, Jr.
*Assistant Examiner* — Kevin Barss
(74) *Attorney, Agent, or Firm* — Howard & Howard Attorneys PLLC

(57) ABSTRACT

A gas regulating fitting that ensures simple manual operation is to be created. In particular, the device is to be capable of being switched both on and off in one operation. To that end, a microswitch (12) connected to an electronic control unit is arranged on the housing (1). The microswitch is operated when a tappet (10) arranged axially to the safety pilot valve (26) and the main valve (19) is manually operated. The electronic control unit thereby receives an electrical signal whereby the gas regulating fitting is activated in its switched-off state, and the gas flow flowing through the open safety pilot valve (26) is therefore ignited, whereas the holding current flowing to the thermoelectric safety pilot valve (26) is interrupted in the switched-on state of the gas regulating fitting, and the gas regulating fitting is therefore deactivated. The gas regulating fitting can be used to ignite and regulate a gas flow flowing to a burner.

5 Claims, 2 Drawing Sheets

(56) References Cited

U.S. PATENT DOCUMENTS

Figure 1:
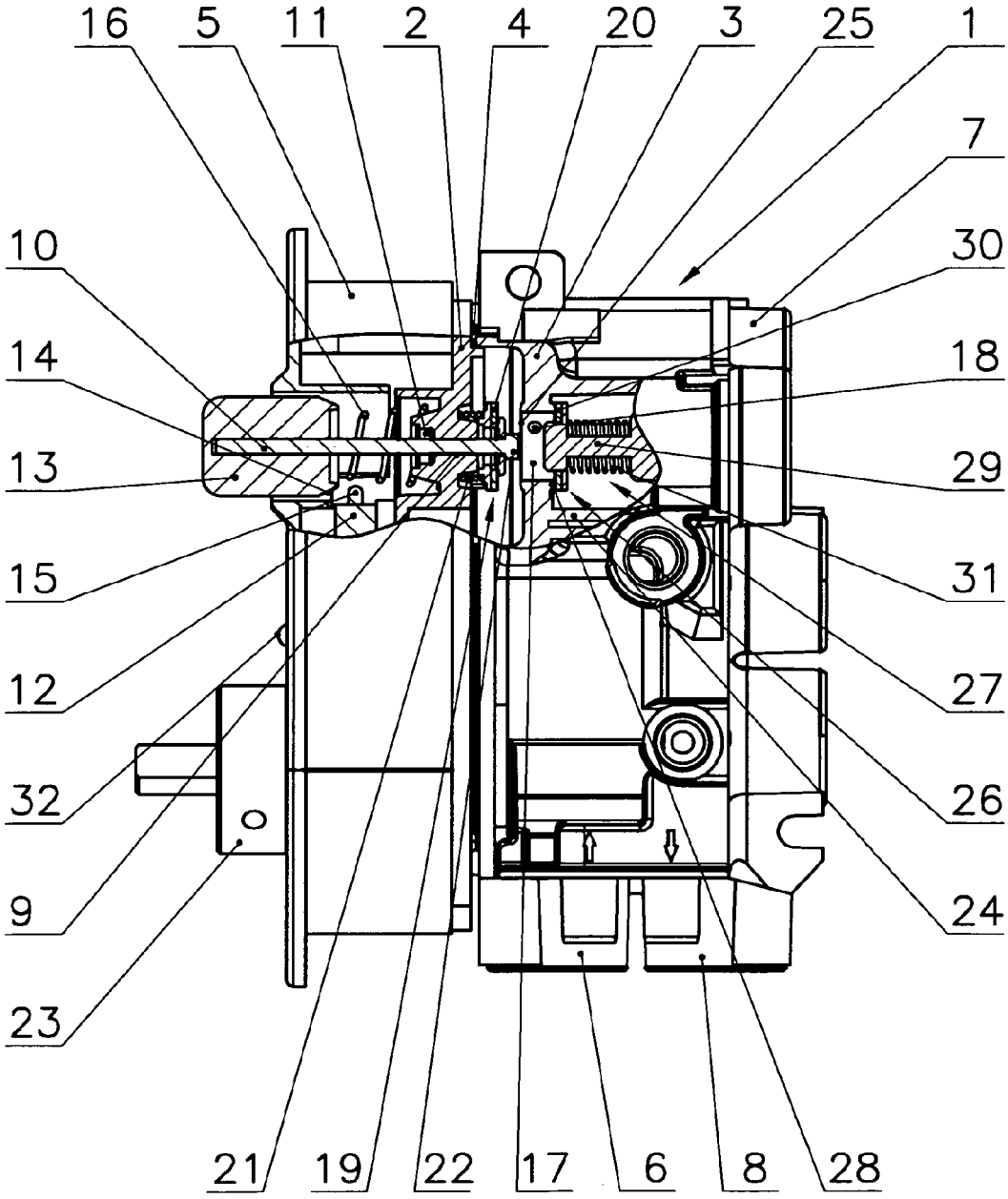

| | | | | |
|---|---|---|---|---|
| 4,055,164 | A * | 10/1977 | Wu-Heng | 126/351.1 |
| 4,190,414 | A * | 2/1980 | Elmy | 432/46 |
| 4,318,687 | A * | 3/1982 | Inoue | 431/54 |
| 4,382,773 | A * | 5/1983 | Sobole | 431/264 |
| 4,830,602 | A * | 5/1989 | Kaselow | 431/80 |
| 5,094,259 | A * | 3/1992 | Hsu | 137/66 |
| 6,029,705 | A | 2/2000 | Happe | |
| 6,666,676 | B2 * | 12/2003 | Rodriguez-Rodriguez et al. | 431/67 |
| 7,044,729 | B2 * | 5/2006 | Ayastuy et al. | 431/25 |
| 7,507,085 | B2 | 3/2009 | Happe et al. | |
| 7,919,732 | B2 * | 4/2011 | Blank et al. | 219/507 |
| 2006/0068348 | A1 * | 3/2006 | Blank et al. | 431/78 |
| 2006/0068349 | A1 | 3/2006 | Happe et al. | |
| 2006/0172237 | A1 * | 8/2006 | Happe et al. | 431/72 |
| 2010/0304315 | A1 * | 12/2010 | Gulkanat | 431/6 |
| 2011/0039217 | A1 | 2/2011 | Happe | |

FOREIGN PATENT DOCUMENTS

| | | | |
|---|---|---|---|
| DE | 102008021164 | A1 | 11/2009 |
| GB | 2251342 | A | 7/1992 |
| GB | 2351341 | A | 12/2000 |

OTHER PUBLICATIONS

English language abstract for DE 10309469 extracted from the espacenet.com database on Jul. 18, 2013, 13 pages.

English language abstract for DE 102008021164 extracted from the espacenet.com database on Jul. 18, 2013, 9 pages.

International Search Report for Application No. PCT/EP2011/002181 dated Apr. 7, 2011, 2 pages.

* cited by examiner

GAS REGULATING FITTING

CROSS-REFERENCE TO RELATED APPLICATIONS

The subject patent application claims priority to and all the benefits of International Patent Application No. PCT/EP2011/002181 filed on May 3, 201 with the World Intellectual Property Organization, which claims priority to German Patent Application No. 10 2010 019 960.5 filed on May 5, 2010, both of which are incorporated herein by reference.

TECHNICAL FIELD OF THE INVENTION

The invention relates to a gas regulating fitting with electronic ignition for a gas-fired heating device according to the preamble to the first claim.

PRIOR ART

Gas regulating fittings for a gas-fired heating device such as a gas heating stove or the like are available in a wide number of designs. They serve to ignite and regulate a gas flow flowing to a burner.

For example, DE 103 05 929 B3 describes an arrangement for igniting a gas flow in which, for the purpose of igniting a gas flow by an electronic control unit, a safety pilot magnet is triggered by the generation of a holding current supplied by a voltage source in order to keep open a thermoelectric safety pilot valve shutting off the gas flow. As soon as the safety pilot magnet is energised, a solenoid is briefly energised by a voltage impulse so that an operating rod aligned with the safety pilot valve is movable so far in a longitudinal direction against the force of a restoring spring that the safety pilot valve, whose valve disc is mounted on a valve rod and is loaded in the direction of closure by a restoring spring, opens and positions the anchor of the safety pilot magnet, which is firmly connected to the valve rod. The anchor is restrained by the holding current coming from the voltage source until a thermocouple provides the required holding current after the gas flow has been ignited. To that end the winding of the safety pilot magnet lies on the one hand within the electric circuit of a thermocouple heatable by the pilot light, and can on the other hand be controlled by the electronic control unit.

A disadvantage of this arrangement that the device can be operated only by remote control. The device cannot be operated directly.

DE 103 09 469 B3 provides a means of manual ignition as well as operation by remote control. To that end a cover element is movably mounted on the housing of the gas regulating fitting, with said cover element covering in an initial position a tappet serving to operate a thermoelectric safety pilot valve and a main valve, as well as a push button of a piezoelectric ignition element. In a second position of the cover element an activation of the tappet inevitably occurring when the covering element is shifted ensures that the main valve is in the closed position. Furthermore, the push button and the tappet are released in this position in such a way that the gas flow can be ignited by a manual operation of said push button and tappet.

A disadvantage of this design is that considerable effort is required to operate the gas regulating fitting manually. Furthermore, such an operation is complicated and time-consuming.

SUMMARY OF THE INVENTION

The object of the invention is to ensure a simple means of manually operating a gas regulating fitting with electronic ignition of the gas flow according to the preamble of claim 1. In particular, the device is to be capable of being switched both on and off in one operation.

The problem is solved according to the invention in that a microswitch connected to the electronic control unit is arranged on the housing and is activated in a longitudinal direction against the force of the restoring spring when the tappet is manually activated. The electronic control unit thereby receives an electrical signal, whereby the gas regulating fitting is activated in its switched off state and the gas flow flowing through the opened safety pilot valve is therefore ignited, whereas the holding current flowing to the thermoelectric ignition valve is interrupted when the gas regulating fitting is in its switched-on state, and the gas regulating fitting is therefore deactivated.

A solution eliminating the disadvantages of the prior art referred to above has therefore been found. The operating mode can easily be changed, i.e. switched on or off, by manually activating the tappet.

An advantageous embodiment of the invention is set out in the dependent claim.

One advantageous embodiment of the gas regulating fitting has thus proved to be an arrangement of a display on the housing to display the operating mode, for example an LED which lights up when the gas regulating fitting is switched on.

EXECUTION EXAMPLE

Figure 2:
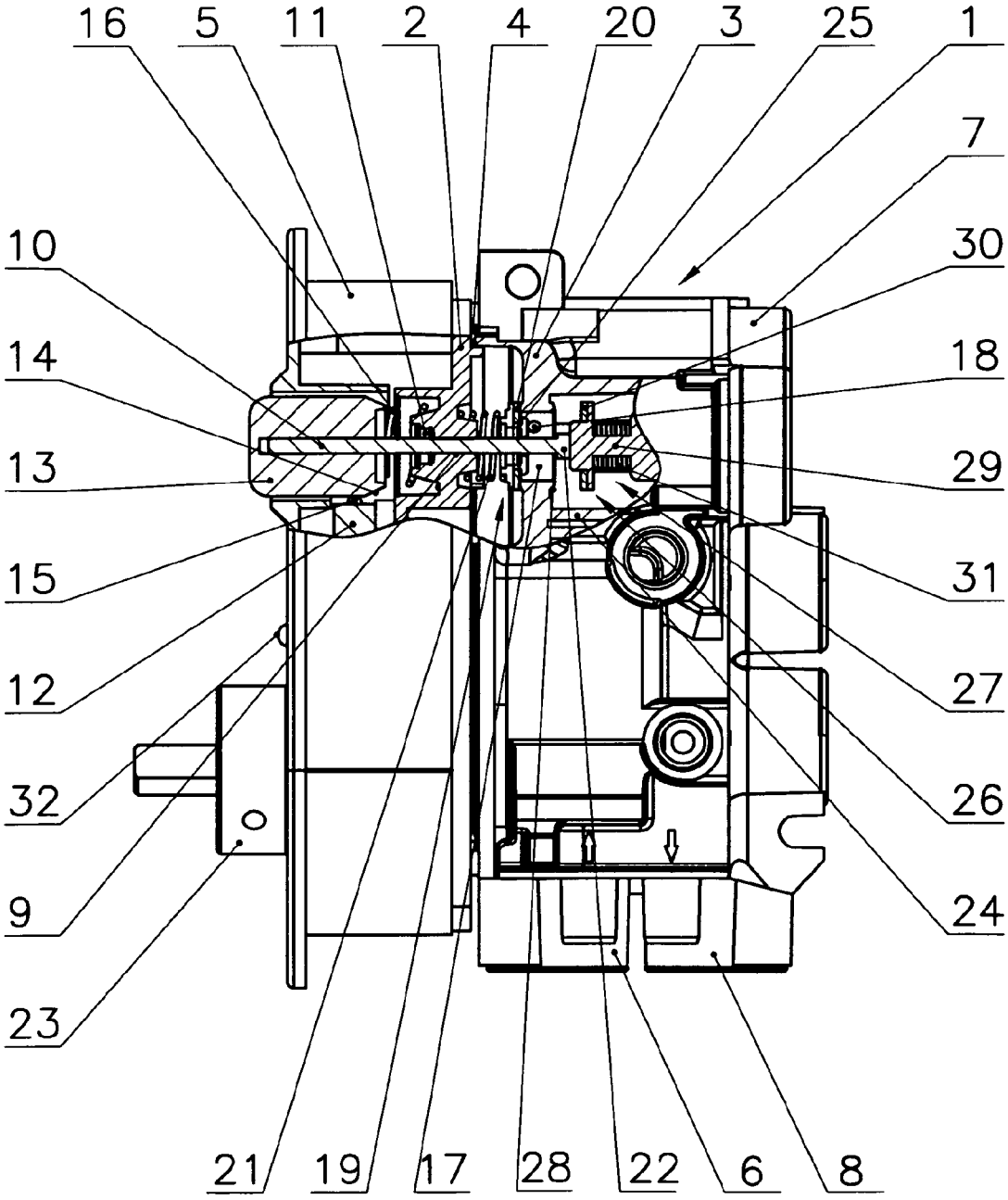

The gas regulating fitting according to the invention fitting is now to be described in more detail by an execution example with the help of drawings which show the following details:

FIG. 1 a partially cutaway view of a version of a gas regulating fitting in the closed position, FIG. 2 a partially cutaway view of a version of a gas regulating fitting on activation of the start-up.

The exemplary embodiment of the gas regulating fitting according to the invention shown in the drawings is a switching and regulatory device intended for installation in gas-fired heating devices or the like. It enables a burner to be operated and monitored by regulating the volume of gas flowing to the burner. In this execution example the burner comprises a pilot light (not shown) and a main burner (also not shown).

The gas regulating fitting shown in the drawings and described below comprises a housing 1 in which various functional units are located, some of which can be operated externally by operating controls. The housing comprises an upper part 2 and a lower part 3, between which a flat seal 4 guarantees external gastightness, as well as a cover 5. In addition, the housing 1 comprises a gas inlet 6, an ignition gas outlet 7 and a main gas outlet 8. The gas regulating fitting comprises the following functional units:

Start-up with safety pilot

Control unit for the volume of gas flowing to the main burner

The device is triggered by an electronic control unit (not shown) which is located in this example together with a voltage source in a separate housing (not shown) that can be installed in any room.

To start up the device a tappet 10, whose end extends into the interior of the housing 1, is longitudinally guided in a bearing 9 of the upper part 2, with the necessary gas tightness ensured for example by O-rings 11. The movement of the tappet 10 in a longitudinal direction is possible only against the force of a restoring spring 16 supported in the upper part 2. An operating control 13 with a switching contour 14 on its outer surface is attached on the end of the tappet 10 projecting outwards. In addition, a microswitch 12, whose switching element 15 can be activated by the switching contour 14, is attached between upper part 2 and cover 5.

A valve disc 20 forming part of a main valve 19 is displaceably guided on the area of the tappet 10 projecting into the interior of the upper part 2 and is supported on a stop 22 located on the tappet 10 under the force of a closing spring 21, which bears on the one hand against the upper part 2 and on the other hand against the valve disc 20. The initial position to be assumed under the force of the restoring spring 16 is reached by the valve disc 20 of the main valve 19 bearing against the upper part 2.

The interior of the part of the housing 1 formed by upper part 2 and lower part 3 is divided by a partition 24 into different chambers. The partition 24 has an aperture 17 which is aligned with the extension of the tappet 10 and whose side facing the upper part 2 forms the valve seat 25 for the valve disc 20, and therefore forms in combination with this the main valve 19, whereas the other side of the aperture 17 forms a valve seat 28 forming part of a safety pilot valve 26. An ignition gas borehole 18 leading to the ignition gas outlet 7 discharges into the aperture 17 between both valve seats 25/28. The safety pilot valve 26 is controlled by a thermoelectric safety pilot magnet 27 which is arranged gastight in a bearing of the housing 1 and located downstream of the gas inlet 6. The thermoelectric safety pilot magnet 27 acts on an anchor which is rigidly connected to a valve rod 29 on which the valve disc 30 of the safety pilot valve 26 is attached. The thermoelectric safety pilot magnet 27 can be energised via the electronic control unit as well as via a thermocouple exposed to the pilot light.

In passing it should be noted that the design and the mode of operation of the safety pilot magnet 27 are known to those skilled in the art, and a description of additional details is therefore unnecessary. All that should be stressed is that a restoring spring 31 endeavours to withdraw the anchor from the safety pilot magnet 27 by means of the valve disc 30 serving as a spring hanger.

The control unit for regulating the volume of gas flowing to the main burner, which is not shown as it is known to those skilled in the art, is located within the housing 1 in the direction of flow behind the start-up. It usually comprises a switch which regulates the volume of gas flowing to the main burner.

The switch is for example designed in such a manner that a modulating control and a stepwise on and off switching in the partial load area are provided respectively by an initial and a second valve, with the partial load throughput limited by an adjustable nozzle.

An operating rod, which is connected to the switch and is longitudinally movable, protrudes from the housing 1 and is connected to an operating control 23, with the housing providing at the same time a bearing for said switch.

A display, in this execution example an LED 32, is arranged on the front of the cover. The display is connected to the electronic control unit and wired in such a way that it lights up when the gas regulating fitting is switched on.

The mode of operation of the gas regulating fitting is as follows:

FIG. 1 shows the gas regulating fitting in its switched-off condition. The operating control 13 is under the effect of the restoring spring 16 in its initial position. Although the main valve 19 is opened in this position, the safety pilot magnet 27 is not energised so that the safety pilot valve 26 is closed and no gas can flow to the burner.

In order to switch on the gas regulating fitting the tappet 10 must be moved in a longitudinal direction by the operating control 13 against the force of the restoring spring 16 so that the position shown in FIG. 2 is assumed.

In this process the main valve 19 is initially closed and subsequently the safety pilot valve 26 is opened wide enough for the anchor to bear against the safety pilot magnet 27. The ignition gas can now flow through the ignition gas borehole 18 to the ignition gas outlet 7 and from there to the pilot light through an ignition gas line that is not shown. In addition, the switching element 15 of the microswitch 12 is activated by the switching contour 14 and the gas flowing out at the pilot light is ignited by the electronic control unit by an electrical signal which is sent to said electronic control unit.

As soon as the pilot light is alight, a holding current flows to the safety pilot magnet 27 via a thermocouple controllable by the pilot light so that from this point the safety pilot valve 26 is held in the open position. At the same time the LED 32 lights up. The operating control 13 need no longer be held and returns to its initial position under the effect of the restoring spring 16, with the main valve 19 opening in the process.

The switch can now be activated by the operating control 23 in a known manner, resulting in the second valve initially opening abruptly. The constant volume of gas restricted by an aperture flows through a main gas line (also not shown) via the main gas outlet 8 to the main burner, and is ignited by the pilot light. The flames burn at a minimal level. On further activation of the operating control 23 the volume of gas flowing to the main gas burner is uniformly increased because the first valve now continuously opens, thereby uniformly increasing the volume of gas flowing through the first valve.

If the operating control 13 is operated in the activated condition of the gas regulates ing fitting, which is indicated by an illuminated LED 32, the main valve 19 is closed, and the gas flow to the main burner is therefore interrupted. The simultaneous activation of the microswitch 12 interrupts an electrical signal to the electronic control unit again and the power supply from the thermocouple to the safety pilot magnet 27 is interrupted by said electronic control unit. The safety pilot valve 26 is no longer restrained by the safety pilot magnet 27 and assumes the closed position as soon as the operating control 13 is no longer activated and returns to its initial position. In addition, the LED 32 also goes out. The gas regulating fitting is in the deactivated condition.

The gas regulating fitting according to the invention is not of course restricted to the execution example described. Indeed changes, modifications and combinations can be made without departing from the scope of the invention.

For example, the control unit for the volume of gas flowing to the main burner referred to and described above can of course be dispensed with whenever a constant volume of gas is to flow to the main burner and there is no necessity to regulate this gas flow. On the other hand, the gas regulating fitting can for example have additional functional units, such as a pressure regulator or the like.

The required holding current can for example initially be supplied from a voltage source via the electrical signal sent to the electronic control unit until the thermocouple is activated. This eliminates the need to hold the operating control 13 until the holding current is flowing to the safety pilot magnet 27 when the gas regulating fitting is switched on.

| List of reference numerals | |
|---|---|
| 1 | Housing |
| 2 | Upper part |
| 3 | Lower part |
| 4 | Flat seal |
| 5 | Cover |
| 6 | Gas inlet |

-continued

| List of reference numerals | |
|---|---|
| 7 | Ignition gas outlet |
| 8 | Main gas outlet |
| 9 | Bearing |
| 10 | Tappet |
| 11 | O-ring |
| 12 | Microswitch |
| 13 | Operating control |
| 14 | Switching contour |
| 15 | Switching element |
| 16 | Restoring spring |
| 17 | Aperture |
| 18 | Ignition gas borehole |
| 19 | Main valve |
| 20 | Valve disc |
| 21 | Closing spring |
| 22 | Stop |
| 23 | Operating control |
| 24 | Partition |
| 25 | Valve seat |
| 26 | Safety pilot valve |
| 27 | Safety pilot magnet |
| 28 | Valve seat |
| 29 | Valve rod |
| 30 | Valve disc |
| 31 | Restoring spring |
| 32 | LED |

The invention claimed is:

1. Gas regulating fitting with electronic ignition for a gas-fired heating device or the like with an electronic control unit fed by a voltage source, a thermoelectric safety pilot valve (26) and a main valve (19) which jointly serve both as a safety pilot and also to split the gas flow into components for a main burner and a pilot light, and are accommodated with additional, secondary functional elements in a segmented housing (1), a tappet (10) arranged axially to the safety pilot valve (26) and the main valve (19), which projects from the gas-conducting chamber of the housing (1) and can be activated in a longitudinal direction against the force of a restoring spring (16) such that the safety pilot valve (26) is in the open position and the main valve (19) is in the closed position, characterized in that a microswitch (12) connected to the electronic control unit is arranged on the housing (1) and is switched in a longitudinal direction against the force of the restoring spring (16) on a manual activation of the tappet (10) so that the electronic control unit receives an electrical signal, whereby the gas regulating fitting is activated in its switched-off condition by said electrical signal and the gas flow flowing through the opened safety pilot valve (26) is therefore ignited, whereas upon an activation of the tappet (10) when the gas regulating fitting is in the switched on state, the holding current flowing to the thermoelectric safety pilot valve (26) is interrupted, and the gas regulating fitting is therefore deactivated.

2. Gas regulating fitting according to claim 1, characterized in that a display, preferably an LED (32), is displayed on the housing (1) by means of which the operating mode can be displayed.

3. Gas regulating fitting with electronic ignition for a gas-fired heating device or the like with an electronic control unit fed by a voltage source, a thermoelectric safety pilot valve (26) and a main valve (19) which jointly serve both as a safety pilot and also to split the gas flow into components for a main burner and a pilot light, and are accommodated with additional, secondary functional elements in a segmented housing (1), a tappet (10) arranged axially to the safety pilot valve (26) and the main valve (19), which projects from the gas-conducting chamber of the housing (1) and can be activated in a longitudinal direction against the force of a restoring spring (16) such that the safety pilot valve (26) is in the open position and the main valve (19) is in the closed position, characterised in that a microswitch (12) connected to the electronic control unit is arranged on the housing (1) and is switched in a longitudinal direction against the force of the restoring spring (16) on a manual activation of the tappet (10) so that the electronic control unit receives an electrical signal, whereby the gas regulating fitting is activated in its switched-off condition by a first electrical signal and the gas flow flowing through the opened safety pilot valve (26) is therefore ignited, and the holding electric current flowing to the thermoelectric safety pilot valve (26) is interrupted when the gas regulating fitting is in the switched on state by a second electrical signal from the electronic control unit and the gas regulating fitting is therefore deactivated.

4. Gas regulating fitting according to claim 3, characterised in that a display, preferably an LED (32), is displayed on the housing (1) by means of which the operating mode can be displayed.

5. Gas regulating fitting with electronic ignition for a gas-fired heating device or the like with an electronic control unit fed by a voltage source, the gas regulating fitting comprising:

a thermoelectric safety pilot valve (26) and a main valve (19) which jointly serve both as a safety pilot and also to split a gas flow into components for a main burner and a pilot light, the thermoelectric safety pilot valve (26) having an electronically activated magnet selectively energized by the electronic control unit and a thermocouple exposed to the pilot light;

a housing (1) enclosing the thermoelectric safety pilot valve (26) and main valve, and including a gas-conducting chamber;

a tappet (10) arranged axially to the safety pilot valve (26) and the main valve (19), and projecting from the gas conducting chamber;

a restoring spring (16) disposed within the housing biasing the tappet (10) in a longitudinal direction such that the safety pilot valve is in a closed position and the main valve is in an open position;

a microswitch (12) arranged in the housing and connected to an electronic control unit;

the gas regulating fitting configured such that in a deactivated condition manual activation of the tappet (10) in a longitudinal direction against the force of the restoring spring (16) disposes the safety pilot valve (26) in an open position, disposes the main valve (19) in a closed position, and actuates the microswitch (12) to generate an electrical signal received by the electronic control unit to ignite the pilot gas flow;

the gas regulating fitting further configured such that in an activated condition, manual activation of the tappet actuates the microswitch to generate an electrical signal received by the electronic control unit to interrupt the power flow from the thermocouple to the thermoelectric safety pilot valve (26).

* * * * *